US006746050B2

(12) United States Patent
Peleman

(10) Patent No.: US 6,746,050 B2
(45) Date of Patent: Jun. 8, 2004

(54) END LEAF AND BINDING ELEMENT CONTAINING SUCH AN END LEAF

(75) Inventor: Guido Peleman, Puurs (BE)

(73) Assignee: Unibind (Cyprus) Limited, Nicosia (CY)

( * ) Notice: Subject to any disclaimer, the term of this patent is extended or adjusted under 35 U.S.C. 154(b) by 0 days.

(21) Appl. No.: 09/998,215

(22) Filed: Dec. 3, 2001

(65) Prior Publication Data

US 2002/0089167 A1 Jul. 11, 2002

(30) Foreign Application Priority Data

Dec. 7, 2000 (BE) ..... 200010776

(51) Int. Cl.[7] ..... B42D 1/00

(52) U.S. Cl. ..... 281/21.1; 281/15.1; 281/29; 281/36

(58) Field of Search ..... 281/15.1, 21.1, 281/28, 29, 34, 35, 36, 37

(56) References Cited

U.S. PATENT DOCUMENTS

| | | | | |
|---|---|---|---|---|
| 3,833,244 A | * | 9/1974 | Heimann | 281/21.1 |
| 4,147,380 A | | 4/1979 | Nelson | |
| 4,441,950 A | * | 4/1984 | Lolli | 156/216 |
| 4,446,184 A | * | 5/1984 | Bowser | 428/57 |
| 4,596,408 A | * | 6/1986 | Carter et al. | 281/36 |
| 5,425,554 A | * | 6/1995 | Lamanna | 281/21.1 |

FOREIGN PATENT DOCUMENTS

GB 2 197 256 A 5/1988

* cited by examiner

*Primary Examiner*—Monica S. Carter
(74) *Attorney, Agent, or Firm*—Bacon & Thomas, PLLC

(57) ABSTRACT

An end leaf of the type which is meant to be used in combination with binding means with which a bundle of loose leaves (6) can be bound, wherein this end leaf (1) comprises at least a leaf (2) made of synthetic material and a strip-shaped part (4) firmly attached to an edge (3) of said leaf (2) which is suppler than the above-mentioned leaf (2).

10 Claims, 3 Drawing Sheets

END LEAF AND BINDING ELEMENT CONTAINING SUCH AN END LEAF

BACKGROUND OF THE INVENTION

1. Field of the invention

The present invention concerns an end leaf, as well as a binding element containing such an end leaf.

In particular, the invention concerns an end leaf of the type which is meant to be used in combination with binding means with which a bundle of loose leaves can be bound.

2. Description of the related art

It is known that when binding a bundle of loose leaves on the front side and/or back side of this bundle, a relatively rigid end leaf made of cardboard or synthetic material can be provided. When such a conventional end leaf is used in combination with binding means which keep the bound bundle of leaves fixed near the bound-in edge, there is a disadvantage in that it is difficult to open such an end leaf due to its rigidity. Such binding means may for example consist of binding elements with a rigid, U-shaped back section, whereby the bundles of loose leaves can be attached in this back section by means of heat-sensitive glue; of binding elements containing two sections or such, in between which the bundle, together with the end leaves, is fixed at one edge; and in the simplest embodiment also of staples which are provided through the bundle at one edge.

In the case of cardboard end leaves, the above-mentioned problem was already solved by locally breaking the fibers of the cardboard, so that a folding line is created.

However, for end leaves which are mainly formed of synthetic material, in particular of a relatively rigid type of plastic, there is no good solution at hand yet. Providing a cold folding line in synthetic material, as is the case with cardboard, is little efficient and will rather rapidly cause a crack. Providing a hot folding line often implies an improvement thanks to the local bonding of the material, but the technique is very unstable, as the dilution has to be carried out with much precision, which entails a level of difficulty which is too high to be able to do this with the required precision in a mass production process. Moreover, the problem still remains that the synthetic material will easily crack after said dilution.

SUMMARY OF THE INVENTION

The invention aims an end leaf which is mainly formed of synthetic material, offering an efficient solution to the above-mentioned problem.

To this end, the invention concerns an end leaf of the above-mentioned type, characterized in that the end leaf at least consists of a leaf made of synthetic material and a connection strip or strip-shaped part firmly attached to the edge of said leaf which is suppler than the above-mentioned leaf. Thus, the end leaf with the strip-shaped part can be situated along the edge to be bound of the bundle of documents to be bound, so that, after the binding operation has been carried out, the end leaf can be easily opened thanks to the presence of the suppler strip-shaped part.

The strip-shaped part may consist of any material whatsoever, but preferably it is also made of synthetic material.

Another interesting possibility is that it is made of paper.

According to a preferred embodiment, the end leaf is provided with means which stiffen the strip-shaped part, whereby these means are situated at a distance from the above-mentioned edge of the leaf, such that, between the leaf and the above-mentioned means, there will remain a non-stiffened, supple part. These means preferably consist of a strip of material which is attached onto the strip-shaped part, for example made of paper, cardboard or such.

The use of these means, in particular of such a reinforcing strip of material, offers the advantage that a relatively stable edge is obtained, although a supple and flexible part remains present in the end leaf. Such a stable edge is particularly advantageous when such an end leaf is used in combination with a binding element having a U-shaped back section. Indeed, such a reinforced edge can be more easily pushed in the U-shaped form of said back section, together with a bundle of loose leaves, than in the case where no reinforcement is provided.

The invention also concerns binding elements provided with such an end leaf, in particular binding elements whereby such an end leaf is a fixed part thereof.

BRIEF DESCRIPTION OF THE DRAWINGS

In order to better explain the characteristics of the invention, the following preferred embodiments are described as an example only without being limitative in any way, with reference to the accompanying drawings, in which.

DETAILED DESCRIPTION OF PREFERRED EMBODIMENTS

Figure 1:
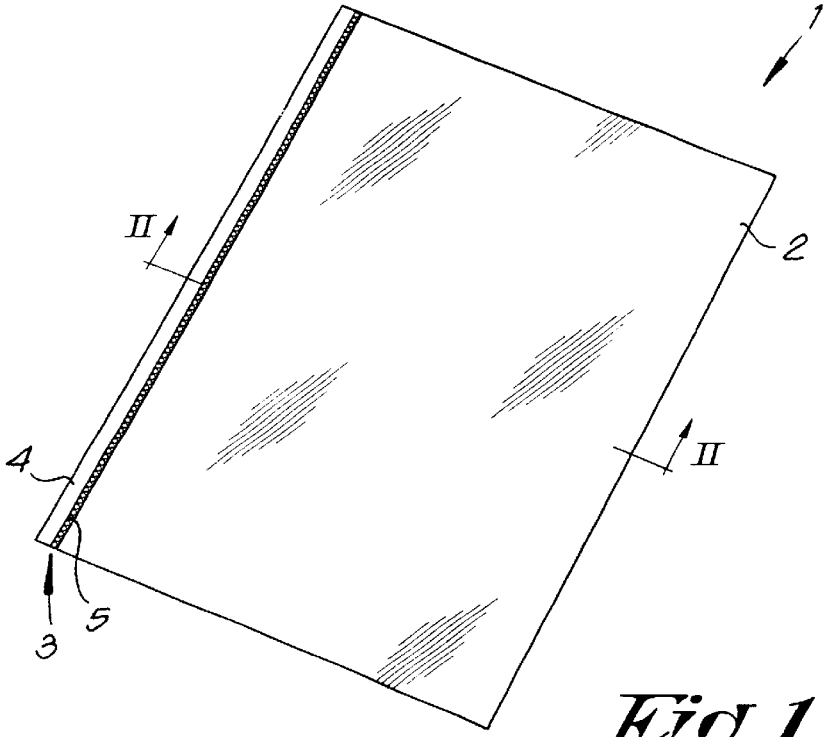
FIG. 1 represents an end leaf according to the invention in perspective.
Figure 2:
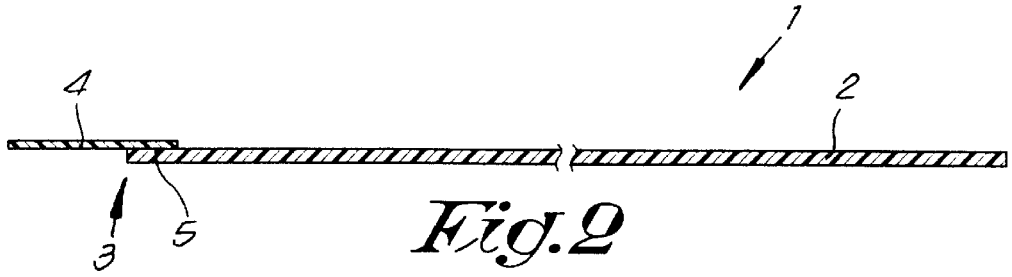
FIG. 2 represents a section according to linen II—II in FIG. 1 to a larger scale.

As represented in FIGS. 1 and 2, an end leaf 1 according to the invention mainly consists of a leaf 2 made of synthetic material and of a connection strip or strip-shaped part 4 fixed to an edge 3 of this leaf 2 which is suppler than the leaf 2.

The strip-shaped part 4 is fixed to the leaf 2 by means of a joint 5, consisting of a laser joint or a glued joint. Naturally, variants with other joints are possible.

Also the strip-shaped part 4 preferably consists of synthetic material, but in conformity with the invention, it is made suppler than the leaf 2, as this strip-shaped part 4 is made of a thinner layer of material than the leaf 2, and/or as another, suppler sort of plastic is used. By making the leaf 2 as well as the part 4 out of synthetic material, it is easy to provide a welded joint by leading the leaf 2 and the strip-shaped part 4 for example between two heated press-on rollers. In a production process, this can already take place before the strip-shaped part 4 and the leaf 2 are cut to the required length.

In particular, the leaf 2 and the strip-shaped part 4 will be both transparent, especially as use is made to this end of for example transparent PVC foil.

Figure 3:
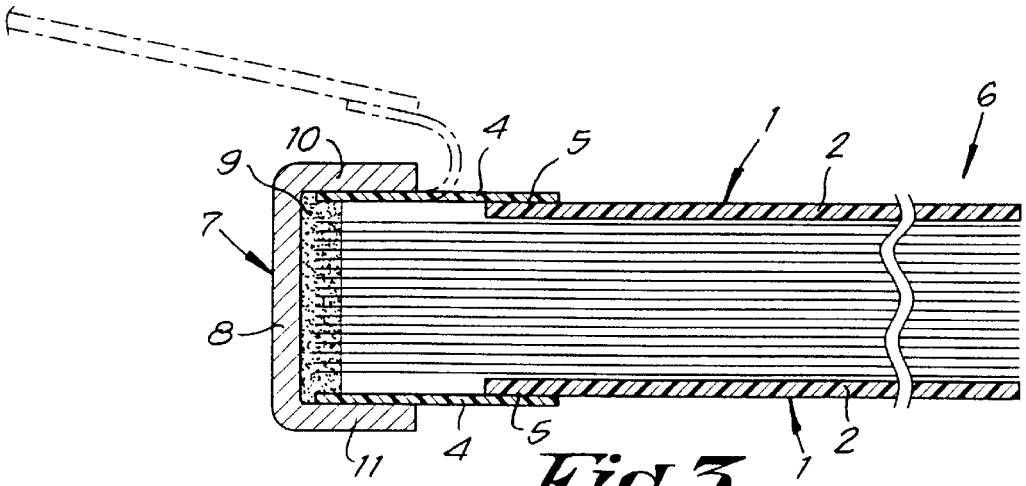
FIG. 3 represents a bundle of leaves bound by means of a U-shaped binding element which is provided with end leaves from FIG. 1.

FIG. 3 represents an application in which a bundle of loose leaves 6, provided with an end leaf 1 on the front side and the back side, is bound in a binding element 7, consisting of a U-shaped section 8, for example made of metal, in which is situated an amount of heat-sensitive glue 9. When using conventional, relatively stiff end leaves, the lateral parts 10–11 of the section 8 would make it difficult to open such end leaves. As end leaves 1 according to the invention are used now, the strip-shaped part 4 makes it possible for the end leaf 1, as represented by means of a dot and dash line, to be opened more easily.

Figure 4:
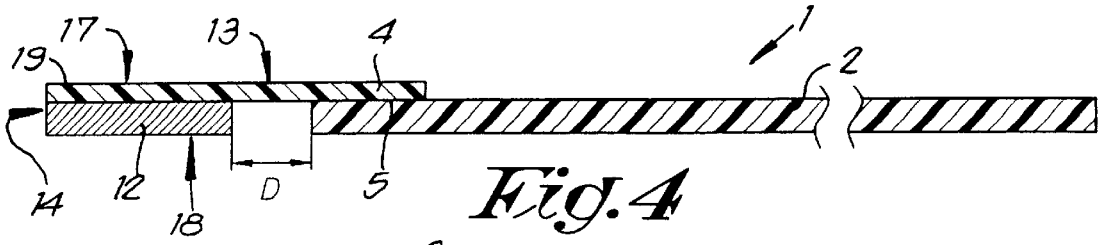
FIG. 4 represents a view analogous to that in FIG. 2 of a variant of an end leaf according to the invention.

FIG. 4 represents a variant in which the end leaf 1 is provided with a stiffener element 12 means, in this case a strip of material 12 provided on the strip-shaped part 4, which stiffens stiffen the strip-shaped part 4, whereby this stiffener element 12 is situated at a distance D from the above-mentioned edge 3 of the leaf 2, such that between the leaf 2 and the above-mentioned means, there will remain a non-stiffened part 13.

The stiffener element 12 preferably comprises paper, cardboard or such, and it is glued for example onto the strip-shaped part 4.

Figure 5:
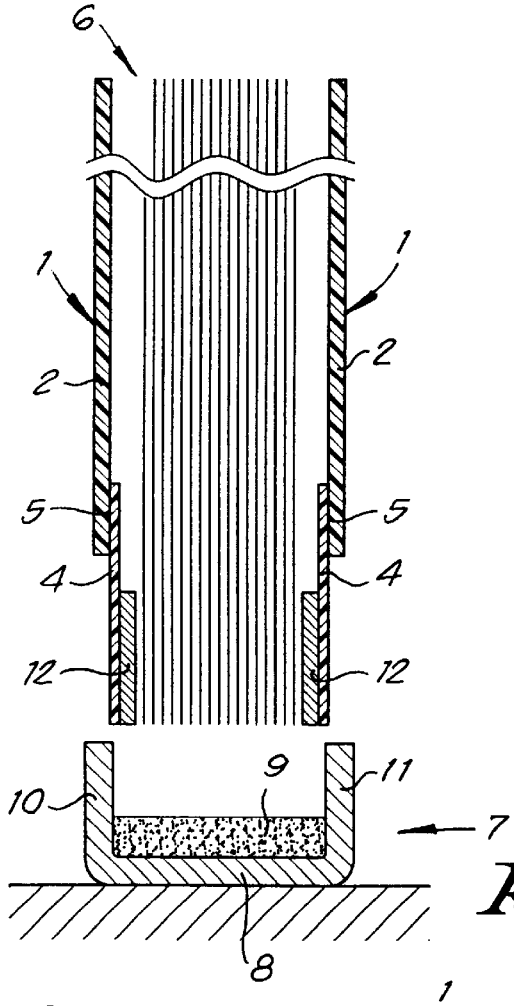
FIG. 5 represents an application in which end leaves according to FIG. 4 are used.

The application of the stiffener element 12, offers the advantage that the free edge 14 of the end leaf 1 remains stable, in spite of the use of the preferably relatively supple strip-shaped part 4. As is schematically represented in FIG. 5, this is particularly advantageous when a bundle of loose leaves 6 must be provided in a U-shaped section 8 as mentioned above, together with one or two end leaves 1. The edges which are reinforced by means of the stiffener element 12 allow for a better positioning of the bundle in the section 8.

Figure 6:
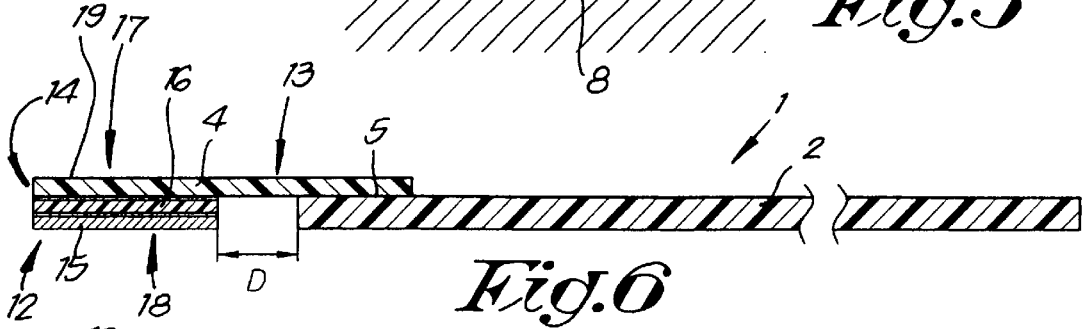
FIGS. 6 and 7 represent two more variants of the invention.
Figure 7:
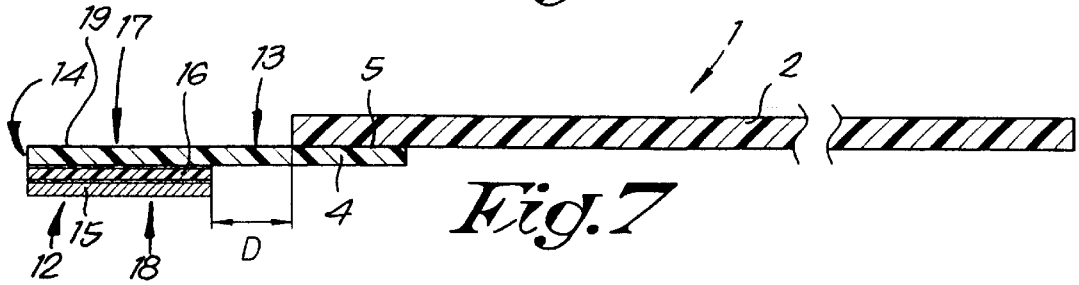

FIG. 6 represents a variant in which the strip-shaped part 4 is transparent, whereas the stiffener element 12 a layer of paper 15 and a decorative layer 16 provided on it, for example made of thin, colored, synthetic foil, whereby the stiffener element is situated against the strip-shaped part 4 together with said decorative layer 16.

The decorative layer 16 must not necessarily consist of a separate layer of material, but it may also consist of a print or such.

It is clear that thus is obtained that, when looking at the end leaf 1, one side will be automatically regarded as the outer side or decorative side, while the other sides will be regarded as the inner sides. Indeed, when the user looks at the side 17 of the end leaf 1, he will observe the decorative layer 16 through the transparent strip-shaped part 4, whereas, when he looks at the end leaf 1 on the side 18, he will notice the matte, preferably colorless paper 15. Also, when applying end leaves 1 around a bundle of loose leaves 6, the user will position these end leaves 1 such that they are turned with their sides 17 to the inside. Thus is automatically obtained that the smooth outer side 19 of the strip-shaped part 4 is directed outward, such that the strip of material 12 cannot cause any hindrance when said bundle 6 is to be pushed in a binding element 7.

Figure 8:
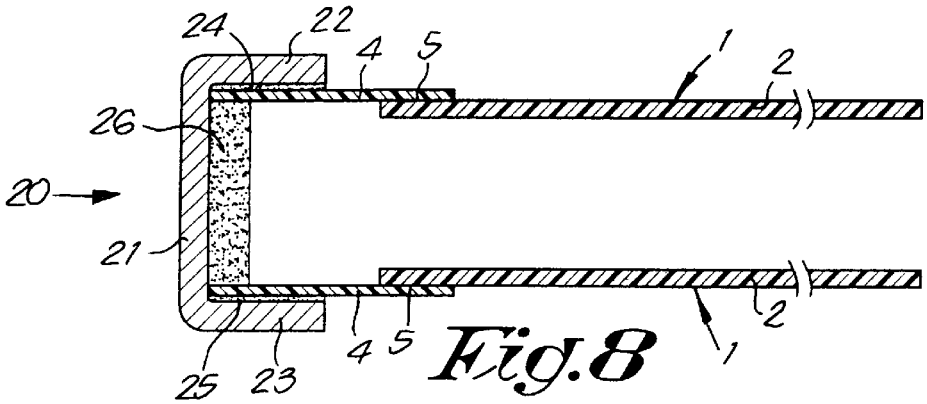
FIG. 8 represents a binding element according to the invention.

FIG. 8 represents a binding element 20 according to the invention whereby two end leaves 1 as mentioned above are firmly fixed to a U-shaped back part 21. The end leaves 1 are hereby fixed to the lateral parts 22–23 of the back part 21 by means of their strip-shaped part 4, such by means of glued joints 24–25. Further, a glue 26 which melts when heated is provided in the U-shaped back part 21.

It is clear that, according to a variant, such a binding element 20 can also be realized with only one end leaf 1.

Figure 9:
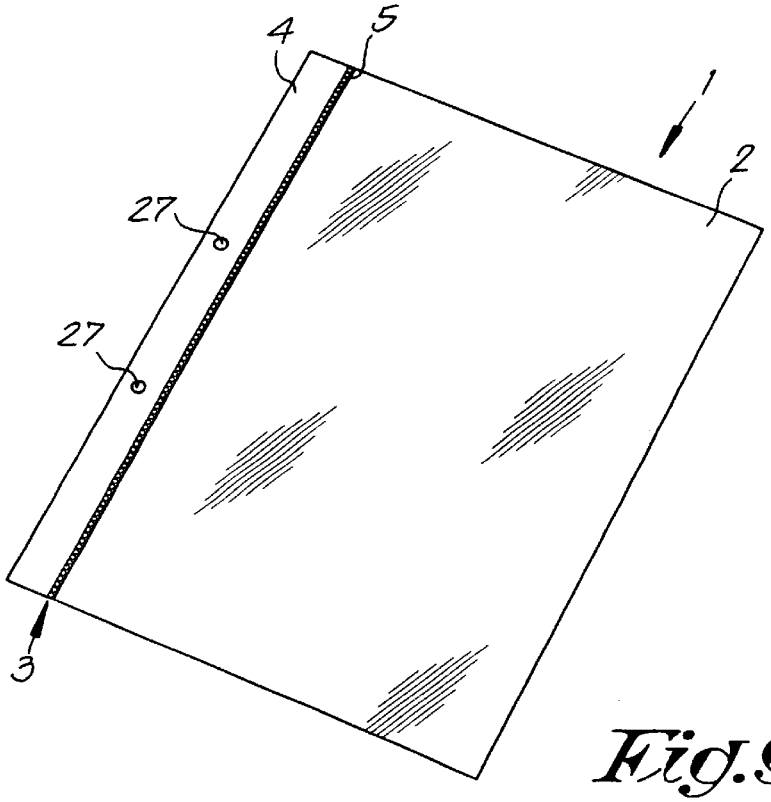
FIG. 9 represents a view in perspective of a variant of an end leaf according to the invention.

FIG. 9 represents a variant in which the strip-shaped part 4 is provided with binding perforations 27.

Figure 10:
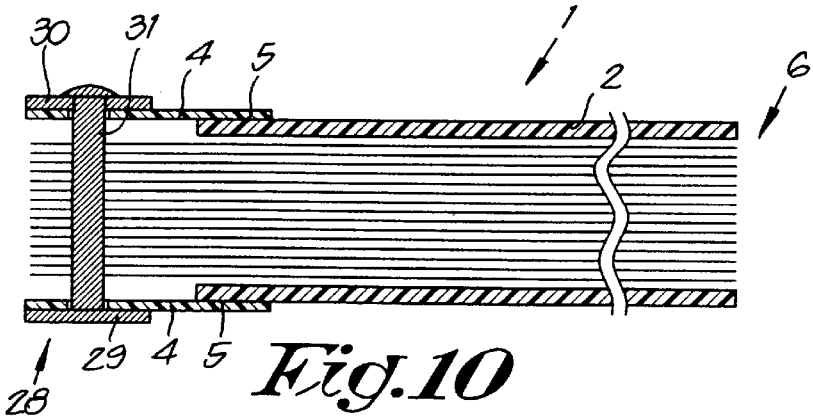
FIG. 10 represents an application in which end leaves according to FIG. 9 are used.

End leaves 1 according to FIG. 9 are for example useful when a bundle of loose leaves 6, together with one or several of such end leaves 1, is bound by means of a binding element 28 as represented in FIG. 10, in particular a binding element 28 of the type whereby the bundle 6 is fixed between two sections 29 and 30 at one edge, whereby also connecting parts 31 stick through the perforations 27 as well as through the perforations provided in the leaves.

It should be noted that, in the figures, the different layers of material, such as the leaf 2 and the strip-shaped part 4, are represented proportionally thicker for clarity's sake. In reality, these are thin layers. Thus, for example, the leaf 2 will in reality have a thickness in the order of magnitude of 0.15 mm, whereas the strip-shaped part 4 has a thickness in the order of magnitude of 0.05 mm.

The invention is by no means limited to the above-described embodiments represented in the accompanying drawings; on the contrary, such a leaf as well as the accompanying binding elements can be made in all shapes and dimensions while still remaining within the scope of the invention.

What is claimed is:

1. A binding arrangement used in combination with a binding element arranged to bind a bundle of loose leaves, the binding arrangement comprising:

a leaf made of synthetic material;

a connection strip having a first end portion attached to an edge of said leaf; and a stiffener element attached to a second end portion of the connection strip, said connection strip having a non-stiffened portion defined along its length between the first and second end portions thereof attached to the leaf and stiffener element.

2. The binding arrangement according to claim 1, wherein the connection strip is glued or welded onto the leaf.

3. The binding arrangement according to claim 1, wherein the connection strip is selected from the group consisting of synthetic material and paper.

4. The binding arrangement according to claim 1, wherein said leaf and/or the connection strip are transparent.

5. The binding arrangement according to claim 1, wherein the stiffener element comprises a strip of material fixed on the connection strip.

6. The binding arrangement according to claim 1, wherein the stiffener element is glued to the connection strip.

7. The binding arrangement according to claim 5, wherein the stiffener element is selected from the group consisting of paper and cardboard.

8. The binding arrangement according to claim 5, wherein the stiffener element comprises a paper layer and a decorative layer provided upon the paper layer, the connection strip being transparent.

9. A binding arrangement comprising:

a binding element arranged to bind a bundle of loose leaves;

at least one leaf made of synthetic material; and at least one connection strip having a first end portion attached to an edge of said at least one leaf, and a second end portion;

wherein the binding element defines a U-shaped back part made of a stiff material and the second end portion of the at least one connection strip is secured only against the inner wall of a lateral part of the U-shaped back part.

10. A binding arrangement according to claim 9, wherein the binding arrangement includes two leaves defining first and last pages, each of the two leaves connected to opposed sides of the U-shaped back part via the at least one connection strip.

* * * * *